US005704682A

United States Patent [19]

Gorayeb et al.

[11] Patent Number: 5,704,682

[45] Date of Patent: *Jan. 6, 1998

[54] WALKER SEAT

[76] Inventors: Fred Gorayeb; Rosalind Gorayeb, both of 8 NE 29th St., Wilton Manors, Fla. 33334-1043

[21] Appl. No.: 786,786

[22] Filed: Jan. 21, 1997

Related U.S. Application Data

[60] Provisional application No. 60/028,761 Oct. 22, 1996.

[51] Int. Cl.[6] ..... A47D 13/04

[52] U.S. Cl. ..... 297/5; 297/440.11

[58] Field of Search ..... 297/440.11, 5, 297/6, 228.12; 135/67; 280/87.021

[56] References Cited

U.S. PATENT DOCUMENTS

| | | | |
|---|---|---|---|
| 715,978 | 12/1902 | Carroll | 297/6 |
| 2,665,745 | 1/1954 | Lo Vico | 297/440.1 X |
| 4,621,804 | 11/1986 | Mueller | 297/6 X |
| 4,629,246 | 12/1986 | Fulton | 297/228.12 X |
| 4,676,416 | 6/1987 | Harmon | 297/5 X |
| 4,712,833 | 12/1987 | Sanson | 297/228.12 |
| 4,974,620 | 12/1990 | Quillan et al. | 297/5 X |
| 5,353,824 | 10/1994 | Woods et al. | 297/6 X |

FOREIGN PATENT DOCUMENTS

| | | | |
|---|---|---|---|
| 110727 | 6/1940 | Australia | 297/440.11 |

*Primary Examiner*—Milton Nelson, Jr.
*Attorney, Agent, or Firm*—Joseph Zallen

[57] ABSTRACT

This device comprises a folding seat for walkers. It is inexpensive, easily removable, installable, and storable. It comprises an elongated, flexible sheet whose ends can be bent over and under the side bars of a walker and connected together underneath to form a seat by lace and eyelets. By adjustment of the spacing or overlap of the ends, the height of the seat from the floor is adjustable.

4 Claims, 5 Drawing Sheets

WALKER SEAT

The applicants hereby invoke the benefits of 35 U.S.C. 119(e)(1) with respect to the invention disclosed by the Applicants in pending provisional application Ser. No. 60/028,761, filed Oct. 22, 1996 and incorporate said application by reference.

BACKGROUND OF INVENTION

This invention relates to a folding seat for a walker, and in particular to a seat that is more inexpensive to make and easier to install than the prior art. In particular, it relates to such a seat which can be adjusted to the height of a person who is sitting in the chair.

Examples of the prior art seats for walkers include the following U.S. Patents: U.S. Pat. No. 3,354,893, U.S. Pat. No. 2,798,533, U.S. Pat. No. 3,993,349, U.S. Pat. No. 4,532,948, U.S. Pat. No. 4,907,794, U.S. Pat. No. 4,907,839, U.S. Pat. No. 4,976,620, U.S. Pat. No. 5,280,800, U.S. Pat. No. 5,353,824, U.S. Pat. No. Des. 298,816, and U.S. Pat. No. Des. 331,209.

One object of the present invention is to provide an inexpensive, removable, height-adjustable seat which can be easily attached to a walker.

Other objects and advantages of this invention will be apparent from the description which follows taken together with the appended drawings.

SUMMARY OF INVENTION

Figure 1:
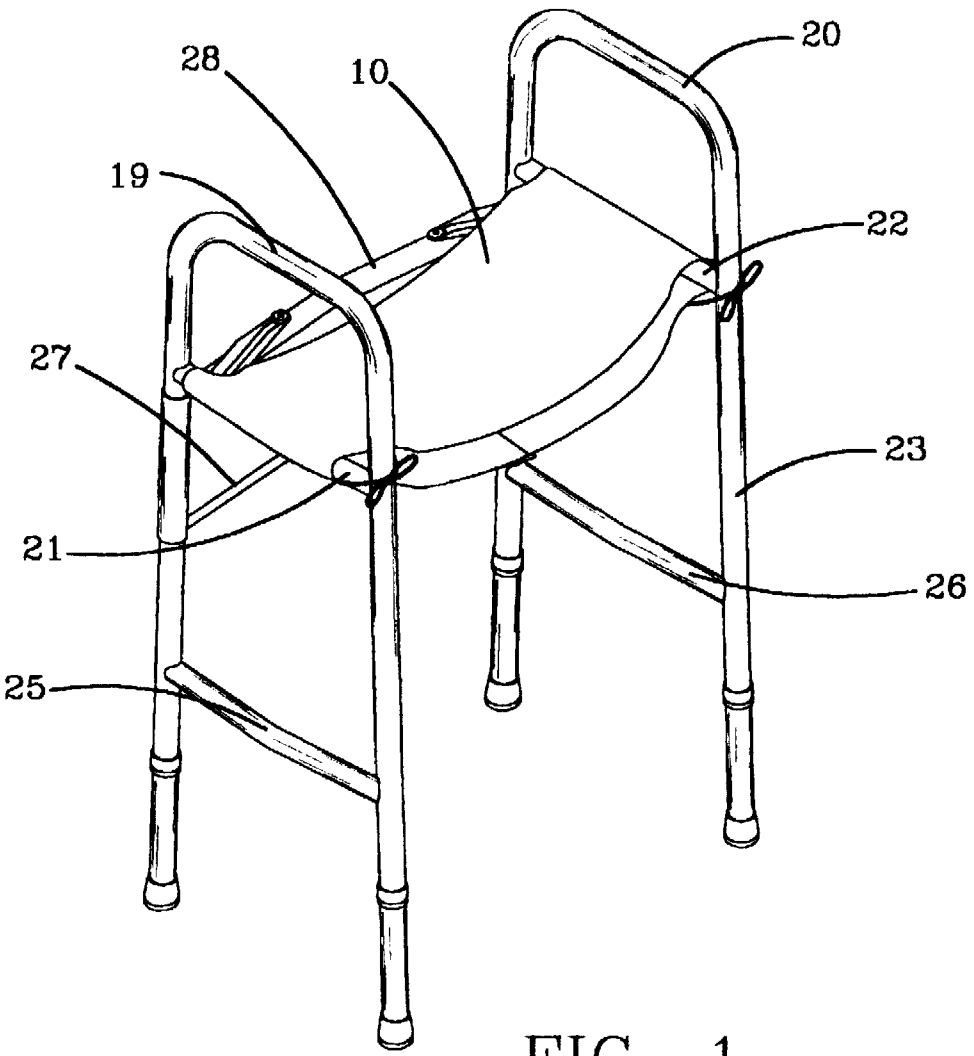
FIG. 1 is a perspective view of an embodiment of the invention attached to a common form of walker.
Figure 2:
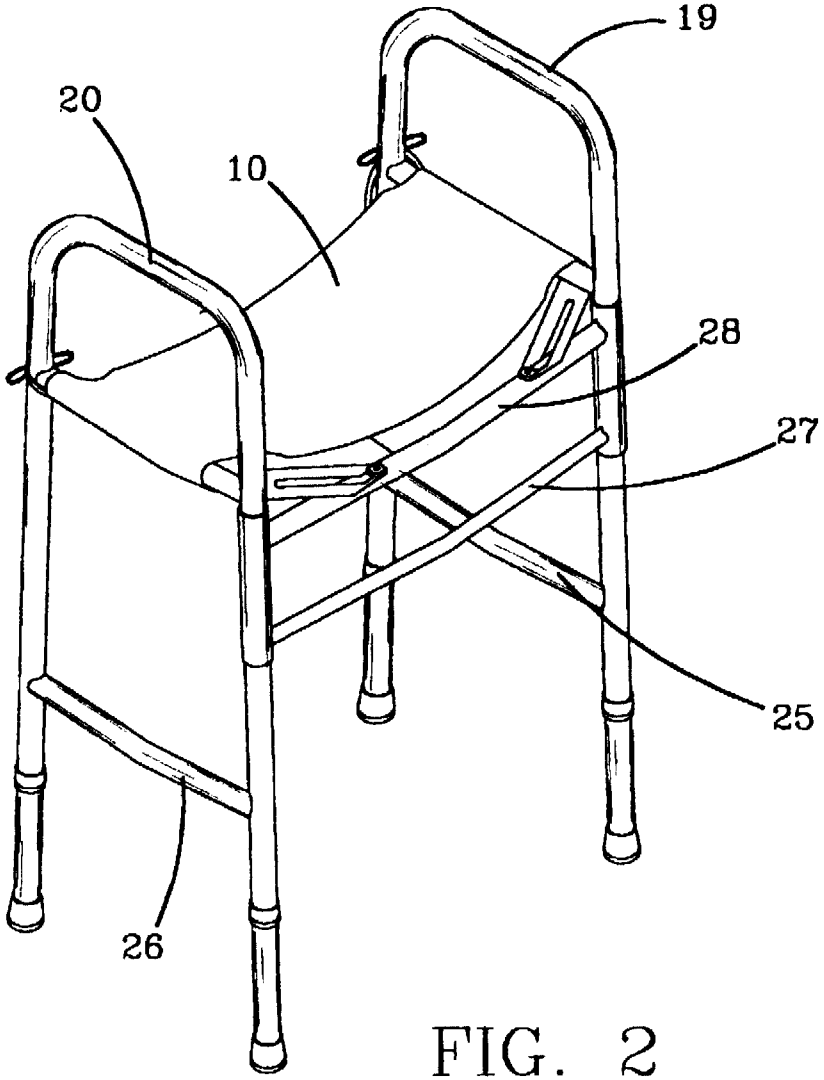
FIG. 2 is a reverse perspective view of FIG. 1.
Figure 3:
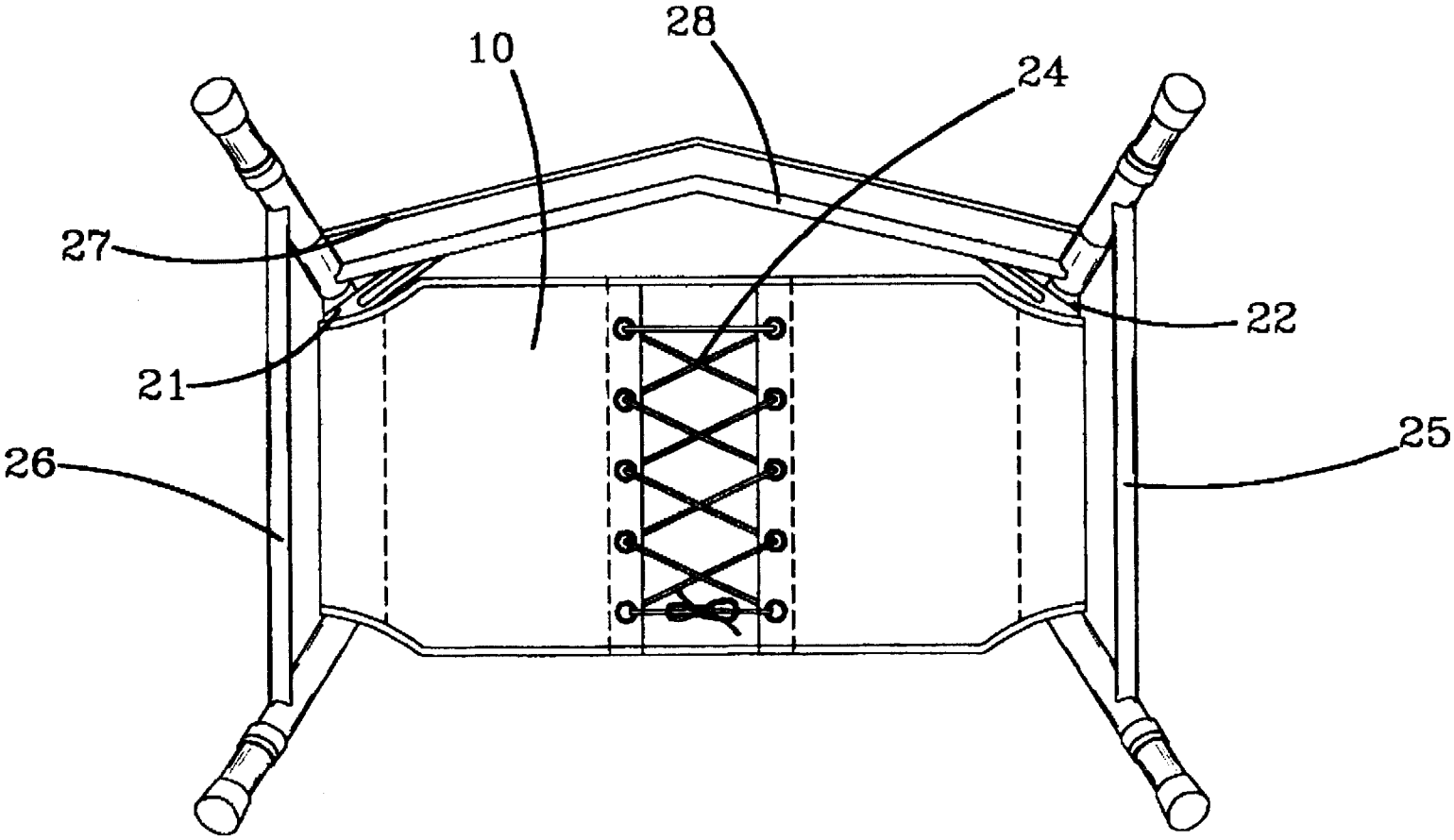
FIG. 3 a bottom view of FIG. 1.
Figure 4:
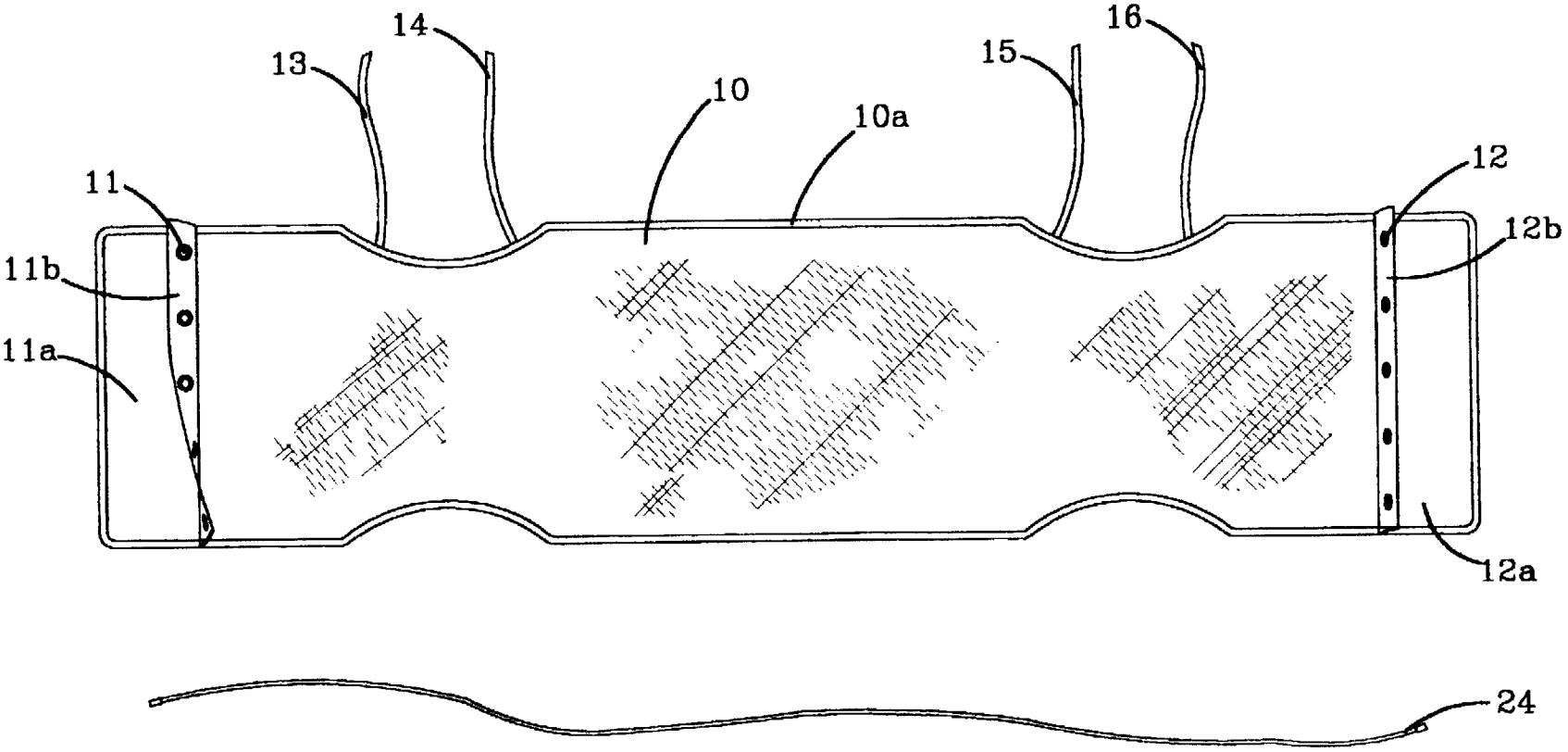
FIG. 4 is a plan view of the same embodiment of the invention as illustrated in FIGS. 1, 2, and 3.
Figure 5:
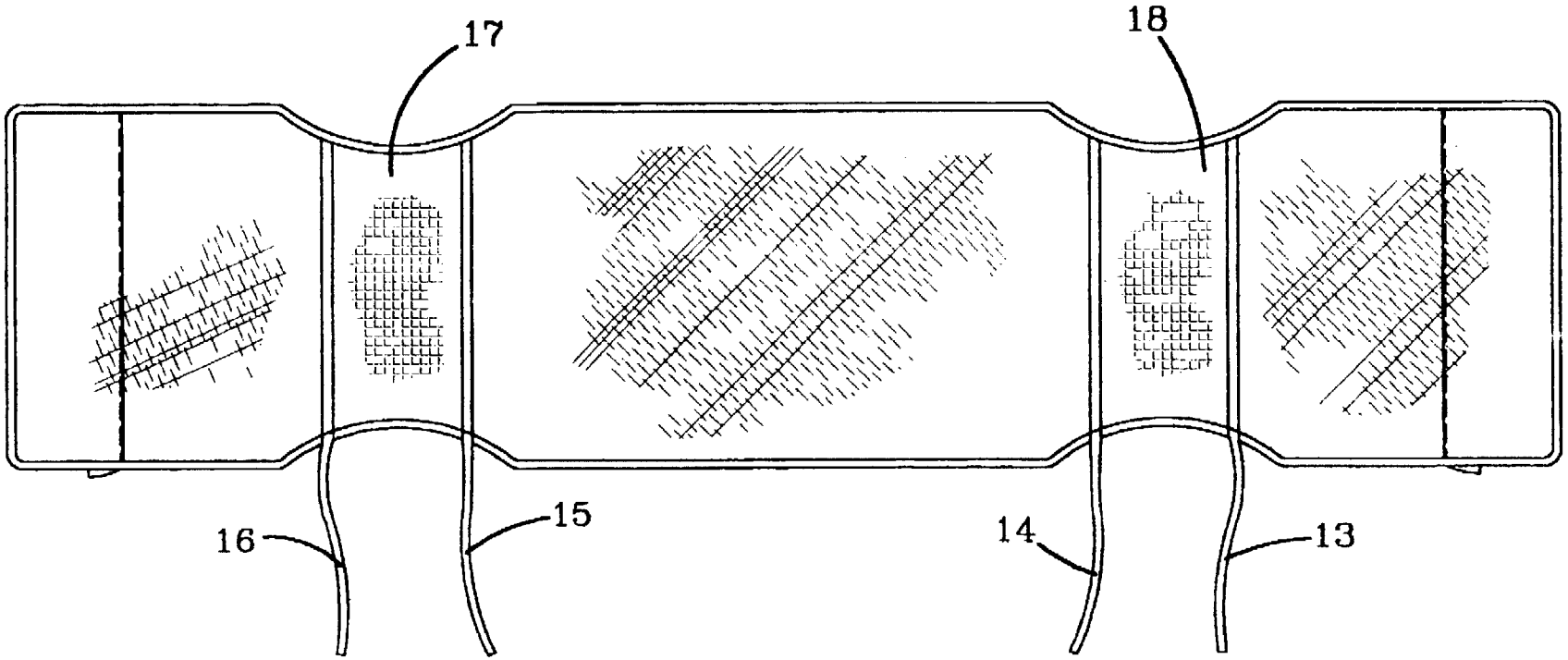
FIG. 5 is a bottom plan view of FIG. 4.

This invention comprises a folding seat for walkers which is characterized as being inexpensive, easily removable, installable, and storable. In its general form it comprises an elongated, flexible sheet whose ends can be bent over and under the side bars of a walker and joined together underneath to form a seat. Examples of joining means are lace and eyelets, zippers, buttons, clasps, straps, buckles, and hooks and loops ("VELCRO"). Where the joining means permits adjustment of the spacing or overlap of the ends, the height of the seat from the floor is adjustable. In its preferred form the joining means comprises a row of eyelets on each end threaded together with a lace so as to provide easy adjustment of the seat height.

DETAILED DESCRIPTION OF INVENTION

As illustrated in the drawings, one embodiment of the invention comprises a sheet of heavy duty duck 10 having a finished edge 10*a* and having transverse rows of eyelets 11 and 12. The row of eyelets 11 are on a strip 11 *b* which is attached on one end to the sheet 10 inwardly from the edge, 11 *a* designating the outer portion. Similarly, the row of eyelets 12 are on a strip 12*b* which is attached on one edge to sheet 10 inwardly from the edge. 12*a* designates the outer portion. Extending from one longitudinal edge of the sheet are spaced pairs of ties 13, 14, 15 and 16. The ties are part of reinforcing sheets 17 and 18 and are attached to the reverse or non-seating surface side of the sheet 10.

The common walker 23 illustrated in the drawings comprises a pair of U-shaped side rails 19, 20, each having an upper hand gripping portion, an upper cross bar 21, 22, a support portion 23, and a lower cross member 25, 26. These U-shaped portions are joined together at the rear by folding cross pieces 28 and cross bar 27.

Installation is accomplished by having the reverse or non-seating surface of the sheet face upward so that the four ties 13–16 face frontward. The sheet is then placed under and over the side rails 21 and 22 below the hand gripping portions of the side rails 19 and 20 of the walker 23. Lace cord 24 is threaded through eyelet arrays 11 and 12. Then the sheet is rotated so that the seat surface is now facing upward and the lace surface is facing downward. The ties are then attached to the side rails 19 and 20 of the walker. In addition to ties, other methods of attachment may be used such as straps, snaps, buckles, buttons, hooks and loops, and "VELCRO".

If the seat is too high for the person in that the person's legs do not rest on the floor, the laces can be made wider apart and then retied. If the seat is too low, the laces can be tightened and then retied. The walker may be folded and stored without removing the seat. No special tools or equipment are needed for attaching or detaching the seat. The invention will fit any standard walker with side parallel bars.

In the particular illustrated embodiment, the sheet is made of 600 by 600 denier 100% polyester and is backed with vinyl. The preferred cord is a length of 5 feet of number 4 polyester.

We claim:

1. A folding seat for a walker having two side rails, each side rail having a cross bar, said seat comprising an elongated flexible sheet having a right end and a left end; said sheet being adapted to be installed on such a walker by having its ends bent over and under said cross bars of the walker and joined together by a single detachable joining means; said detachable joining means being adjustable so as to permit adjustment of the spacing between said ends; spaced pairs of ties extending from only one longitudinal edge of said sheet wherein each said pair of ties is adapted to be tied to a different one of said side rails.

2. The folding seat of claim 1 wherein said detachable joining means comprises a row of eyelets on each end threaded and tied together with a lace.

3. The combination of a folding seat and a walker having two side rails, each side rail having a cross bar; said seat comprising an elongated flexible sheet having a right end and a left end installed on said walker by having its ends bent over and under said cross bars and joined together by a single detachable joining means; said detachable joining means being adjustable so as to permit adjustment of at least one of the spacing or overlap between said ends; spaced pairs of ties extending from only one longitudinal edge of said sheet wherein each said pair of ties is adapted to be tied to a different one of said side rails.

4. The combination of claim 3 wherein said detachable joining means comprises a row of eyelets on each end threaded and tied together with a lace.

* * * * *